US009121561B2

(12) United States Patent
Thullier et al.

(10) Patent No.: US 9,121,561 B2
(45) Date of Patent: Sep. 1, 2015

(54) OPTICAL MODULE OF A LIGHTING AND/OR SIGNALING DEVICE FOR A MOTOR VEHICLE

(75) Inventors: Christophe Thullier, Montigny le Bretonneux (FR); Frédéric Moret, Le Pecq (FR); Julie Vong, Paris (FR); Jean-Luc Meyrenaud, Livry Gargan (FR)

(73) Assignee: Valeo Vision, Bobigny (FR)

( * ) Notice: Subject to any disclaimer, the term of this patent is extended or adjusted under 35 U.S.C. 154(b) by 264 days.

(21) Appl. No.: 13/821,331

(22) PCT Filed: Jul. 22, 2011

(86) PCT No.: PCT/EP2011/062664

§ 371 (c)(1),
(2), (4) Date: Sep. 6, 2013

(87) PCT Pub. No.: WO2012/013601

PCT Pub. Date: Feb. 2, 2012

(65) Prior Publication Data

US 2014/0036523 A1 Feb. 6, 2014

(30) Foreign Application Priority Data

Jul. 26, 2010 (FR) ..... 10 56095
Sep. 9, 2010 (FR) ..... 10 57146

(51) Int. Cl.
*F21S 8/10* (2006.01)

(52) U.S. Cl.
CPC ..... *F21S 48/13* (2013.01); *F21S 48/1159* (2013.01); *F21S 48/1216* (2013.01); *F21S 48/1388* (2013.01); *F21S 48/14* (2013.01); *F21S 48/325* (2013.01); *F21S 48/328* (2013.01)

(58) Field of Classification Search
CPC ..... F21S 48/1388; F21S 48/14
USPC ..... 362/542–545
See application file for complete search history.

(56) References Cited

U.S. PATENT DOCUMENTS

| | | | |
|---|---|---|---|
| 6,966,675 | B2 | 11/2005 | Albou |
| 7,114,837 | B2 | 10/2006 | Yagi et al. |
| 7,144,145 | B2 | 12/2006 | Watanabe et al. |
| 7,201,506 | B2 | 4/2007 | Ishida et al. |
| 7,481,561 | B2 | 1/2009 | Okuda |
| 7,690,818 | B2 | 4/2010 | Takada et al. |
| 7,722,233 | B2 | 5/2010 | Meyrenaud |
| 7,784,955 | B2 | 8/2010 | Choi et al. |
| 7,963,684 | B2 | 6/2011 | Staub et al. |

(Continued)

FOREIGN PATENT DOCUMENTS

| | | |
|---|---|---|
| EP | 1434002 | 6/2004 |
| EP | 1746340 | 1/2007 |

(Continued)

*Primary Examiner* — Mary Ellen Bowman
(74) *Attorney, Agent, or Firm* — Jacox, Meckstroth & Jenkins

(57) ABSTRACT

Optical module for a lighting and/or signaling device of a motor vehicle, in particular a headlight, comprising:

a light source comprising in particular at least one LED, a reflector designed to reflect the light coming from the light source, and a a bending element (8) placed on the path of light coming from the reflector and designed to reflect light coming from the reflector, this bending element being produced on a metal part.

26 Claims, 3 Drawing Sheets

(56) References Cited

U.S. PATENT DOCUMENTS

| | | | |
|---|---|---|---|
| 8,256,944 | B2 | 9/2012 | Yasuda |
| 8,414,171 | B2 | 4/2013 | Kawamura |
| 8,591,081 | B2 | 11/2013 | Inaba |
| 2004/0130907 | A1 | 7/2004 | Albou |
| 2004/0202007 | A1 | 10/2004 | Yagi et al. |
| 2005/0094414 | A1 | 5/2005 | Ishida et al. |
| 2005/0122736 | A1 | 6/2005 | Watanabe et al. |
| 2007/0019430 | A1 | 1/2007 | Meyrenaud |
| 2008/0025036 | A1 | 1/2008 | Takada et al. |
| 2008/0144329 | A1 | 6/2008 | Okuda |
| 2009/0034279 | A1 | 2/2009 | Blandin et al. |
| 2009/0097269 | A1 | 4/2009 | Stauss et al. |
| 2009/0154190 | A1 | 6/2009 | Choi et al. |
| 2009/0303742 | A1 | 12/2009 | Yasuda |
| 2010/0073950 | A1 | 3/2010 | Kawamura |
| 2010/0244649 | A1 | 9/2010 | Inaba |

FOREIGN PATENT DOCUMENTS

| | | | |
|---|---|---|---|
| EP | 1884708 | | 2/2008 |
| EP | 1935715 | A1 | 6/2008 |
| EP | 2020336 | A1 | 2/2009 |
| EP | 2236914 | A1 | 10/2010 |
| FR | 2853717 | | 10/2004 |
| FR | 2861833 | | 5/2005 |
| FR | 2863343 | | 6/2005 |
| FR | 2934667 | | 2/2010 |
| WO | 2005116520 | | 12/2005 |

OPTICAL MODULE OF A LIGHTING AND/OR SIGNALING DEVICE FOR A MOTOR VEHICLE

CROSS-REFERENCE TO RELATED APPLICATIONS

This application is the U.S. National Phase application of PCT/EP2011/062664 filed Jul. 22, 2011, which claims priority to French Application No. 1056095 filed Jul. 26, 2010 and French Application No. 1057145 filed Sep. 9, 2010, which applications are incorporated herein by reference and made a part hereof.

BACKGROUND OF THE INVENTION

1. Field of the Invention

The present invention relates to an optical module of a lighting and/or signaling device of a motor vehicle.

2. Description of the Related Art

It is known practice, for example from documents US 2009/303,742 (now U.S. Pat. No. 8,256,944) and WO 2005/116,520, to produce lighting devices in which the light source is mounted on a radiator onto which an air stream is directed, so that a portion of the heat produced by the light source is dissipated by the radiator into the air stream. This is particularly the case when the light source is of the light-emitting diode type. This makes it possible to obtain powerful lighting devices. However, such devices have drawbacks. They have complex structures and are therefore complicated to assemble. Moreover, it is necessary to put in place tolerances on many parts that have to be assembled together. The chains of dimensions of the various parts are therefore equally complex in these devices.

SUMMARY OF THE INVENTION

The object of the invention is to provide an optical module of a lighting and/or signaling device that remedies the aforementioned drawbacks and that improves the known optical modules of the prior art. In particular, the invention proposes an optical module of simple structure and in which the chains of dimensions are equally simple.

According to one embodiment of the invention, the optical module of a lighting and/or signaling device of a motor vehicle comprises a support, an optical lens and a heat exchanger. The optical lens and the heat exchanger are attached to the support and the support connects the optical lens to the heat exchanger. Preferably, the support directly supports the lens and directly supports the heat exchanger. Thus, it is possible to produce an optical module that is simple and easy to assemble, the chains of dimensions of the various components also being simple.

The support can be designed to be mounted directly or indirectly on the casing of the lighting and/or signaling device and on the inside of this casing.

The support can also support a fan and/or at least one light reflector and/or a bending element and/or a means for channeling air. Preferably, the support directly supports the fan and/or the at least one light reflector and/or the bending element and/or the means for channeling air. Thus, the optical module is further simplified and its assembly is made even easier.

The support may comprise means for positioning the optical lens and/or the fan and/or the at least one light reflector and/or the bending element and/or the heat exchanger, these means interacting with positioning means provided on the optical lens and/or on the fan and/or on the at least one light reflector and/or on the bending element and/or on the heat exchanger.

The optical module may comprise a first and a second light source designed to perform two distinct functions of lighting and/or signaling. The first and second sources may together be designed to perform a lighting function of the high beam type and the second source alone may be designed to perform a lighting function of the low beam type.

The optical module may comprise a light source designed to perform a fog light function.

The support may be capable of being rotatably mounted in a casing of a lighting and/or signaling device of a motor vehicle. Thus, it is possible to orient the axis of the optical module according to the curves negotiated by the vehicle.

The optical module may comprise a base designed to be attached to the casing of the lighting and/or signaling device of the motor vehicle and comprising first articulation means designed to be secured to the support so as to allow the support to rotate relative to the casing. For example, the support may comprise a tenon designed to interact with an orifice of the base, for example one tenon at the top of the support and one underneath, the axis passing through these tenons corresponding to the rotation axis of the module relative to the casing.

The base may comprise a maneuvering mechanism designed to orient the support relative to the casing. According to one embodiment, the base may comprise a driving mechanism from which a drive shaft emerges interacting with an orifice of the module, preferably of the support, so as to rotate the support. As a variant, and as illustrated, the support may be indirectly connected to the base via an intermediate part, for example a frame. The support may then comprise fastening lugs attached to the frame. The frame in this case comprises the means interacting with the first articulation means of the base, for example a tenon at the top and an orifice at the bottom, the tenon turning in the top orifice of the base and the orifice receiving the drive shaft.

The optical lens may be positioned on and attached to the support in the front portion of the latter and the heat exchanger may be positioned on and attached to the support beneath the latter. The optical module may comprise a first and a second light source which are positioned on and attached to the heat exchanger.

The optical module may comprise a first reflector positioned relative to the support and attached to the support, beneath the support, between the support and the heat exchanger.

The optical module may comprise a second reflector positioned relative to the support and attached to the support, beneath the support and the heat exchanger.

The optical module may comprise a bending element positioned on and attached to the support.

The optical module may comprise a fan positioned and attached to the support, for example above the support and/or behind the latter.

The lighting and/or signaling device may comprise a casing in which the support is mounted.

The invention also relates to a motor vehicle comprising a lighting and/or signaling device as defined above.

Another subject of the invention, independently or in combination with the foregoing, is an optical module of a lighting and/or signaling device of a motor vehicle, comprising a reflector associated with a light source, in particular comprising an LED, in order to reflect the light coming from this light source, this reflector being formed on a part, in particular a monolithic part, namely produced in one piece, provided with a cooling opening for a circulation of cooling air.

Preferably, the module comprises a heat exchanger provided with one or more cooling fins extending at least partially in the cooling opening, and, where appropriate, the part on which the reflector is formed has a rear wall, in particular a rounded wall, partially enveloping this fin or these fins.

In one embodiment of the invention, the reflector has a wall, in particular a domed wall, designed to serve to guide the air leaving the cooling opening.

The module may comprise a support, an optical lens and a heat exchanger, and the optical lens and the heat exchanger are both carried by the support.

The support is advantageously produced in one piece, thus being monolithic, obtained in particular by molding a plastic.

If desired, the support comprises a recess for at least partially receiving a reflector.

In one embodiment of the invention, the module comprises first and second reflectors, in particular each associated with at least one dedicated light source, characterized in that one of the reflectors forms, together with the support, an enclosure receiving the other of the reflectors, making it possible in particular to have a relatively compact module.

In one embodiment of the invention, the support comprises at least one attachment arm, in particular two fastening arms, designed to allow the attachment, in particular by adhesive bonding, of the lens, this or these arms projecting toward the front of the support, this or these arms preferably being connected to an annular portion of the support.

The lens advantageously has at least one edge, in particular two opposed edges, in particular a substantially rectilinear edge or edges, this or these edges being designed to be attached to the arm or arms of the support.

The lens may comprise at least one fastening lug for attaching the lens to the support, this lug being formed in particular on the rectilinear edge, this lug being capable of interacting in particular with one or more pins on the attachment arm of the support.

In one embodiment of the invention, the at least one of the first and second reflectors is produced in one piece.

The reflector comprises, where appropriate, two reflective surfaces each associated with a light source.

A further subject of another embodiment of the invention is an optical module for a lighting and/or signaling device of a motor vehicle, in particular a headlight, comprising:

- a light source comprising in particular at least one LED,
- a reflector designed to reflect the light coming from the light source,
- a bending element placed on the path of light coming from the reflector and designed to reflect light coming from the reflector, this bending element preferably being produced on a metal part, preferably a monolithic part.

This bending element is preferably attached in the module in an immovable manner relative to the light source.

The bending element is advantageously provided with lower and upper reflective surfaces, preferably being connected so as to form a bevel having an acute angle, this angle being in particular less than 15°, or else less than 5°, or else less than 2°, or even less than 1°. This makes it possible in particular to obtain improved optical performances, in particular as far as a cut-off in the light beam is concerned.

In one embodiment of the invention, these surfaces of the bending element are locally planar, and preferably the surfaces are not parallel to one another.

The bending element is advantageously formed on a monolithic part, namely produced in one piece, preferably of metal to ensure in particular a better thermal resistance to the heat coming from the light source or sources of the device or from the sun.

If desired, the bending element has a cut-off edge, preferably with a step, to produce a cut-off in the beam.

In one embodiment of the invention, the bending element comprises at least one machined reflective surface.

Where appropriate, the bending element is formed on a part arranged at a non-zero distance from the heat exchanger.

The bending element may comprise front and rear edges that are preferably substantially parallel and in particular substantially rectilinear, the reflective surface or surfaces of the bending element extending between these edges, which are in particular perpendicular to the optical axis of the module.

The bending element advantageously comprises at least one fastening lug, in particular a lateral lug, designed to allow it to be attached to the support. In one embodiment of the invention, the bending element comprises two fastening lugs at the opposed ends of the bending element, these lugs being arranged in particular at the ends of the bending element in the direction of the largest dimension.

The direction of the largest dimension of the bending element is advantageously substantially perpendicular to an optical axis of the module.

These and other objects and advantages of the invention will be apparent from the following description, the accompanying drawings and the appended claims.

BRIEF DESCRIPTION OF THE ACCOMPANYING DRAWINGS

The appended drawing represents, as examples, two embodiments of an optical module of a motor vehicle according to the invention.

DETAILED DESCRIPTION OF THE PREFERRED EMBODIMENTS

Figure 1:
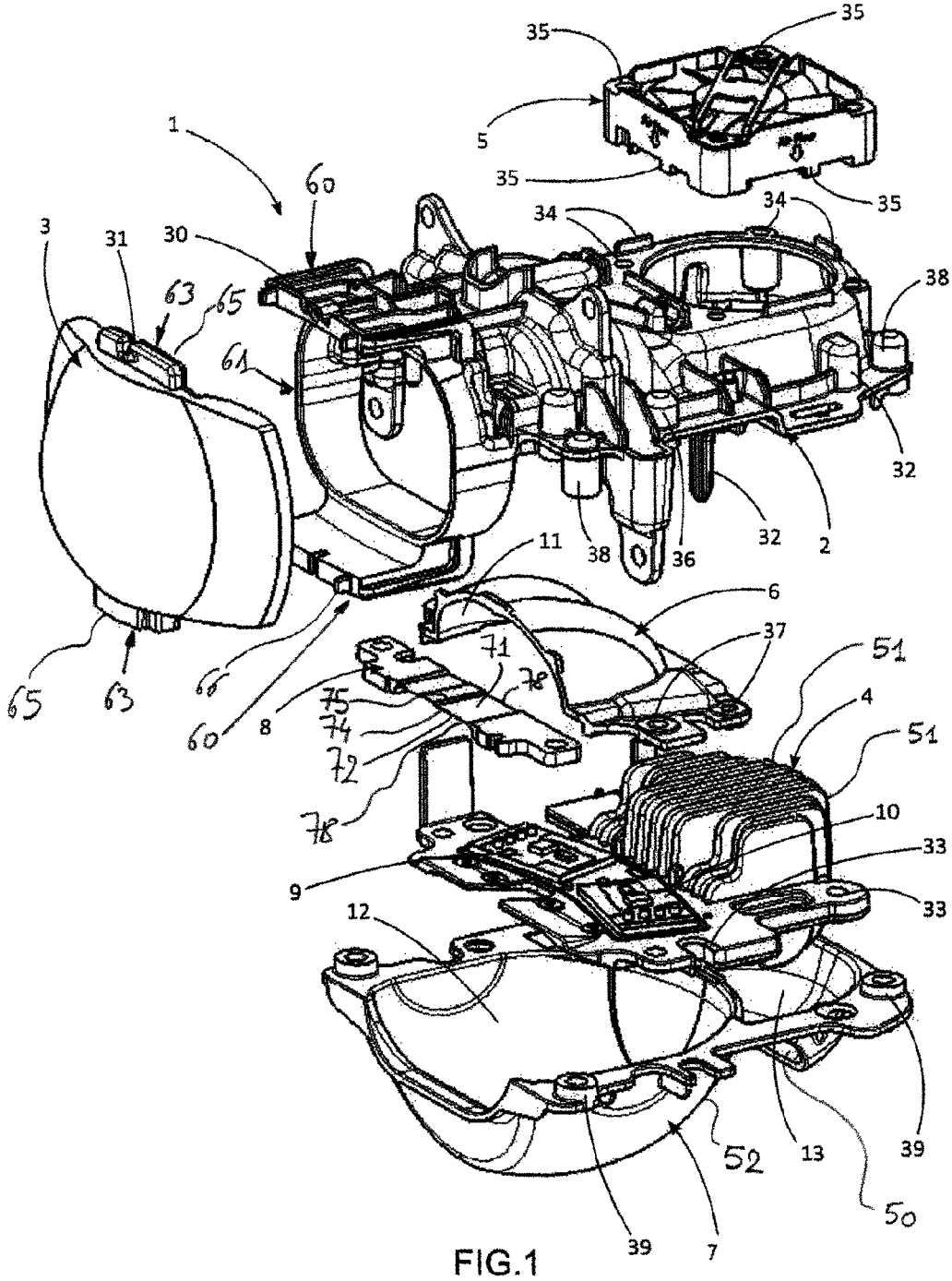
FIG. 1 is an exploded view of a first embodiment of an optical module according to the invention.

A first embodiment of an optical module 1 of a lighting and/or signaling device is described below with reference to FIGS. 1 to 3. In this example, the optical module of a lighting and/or signaling device is an optical module 1 with two functions:

- a function of lighting of the low beam type, and
- a function of lighting of the high beam type.

The optical module 1 comprises mainly a support 2, an optical lens 3, a fan 5, a heat exchanger, such as a radiator 4, a first reflector 6, a second reflector 7 and a bending element 8.

The support 2 comprises means 30 for positioning the optical lens 3 on and attaching it to the support 2. These means 30 interact with means 31 of positioning and of attachment provided on the optical lens 3. The optical lens 3 is thus supported by the support 2. Preferably, the optical lens is directly supported by the support 2.

The support 2 comprises means and apparatus 32 for positioning the radiator 4 on and attaching it to the support 2. These means 32 interact with positioning and attachment means 33 provided on the radiator 4. The radiator is thus supported by the support 2. Preferably, the radiator 4 is directly supported by the support 2.

The support 2 comprises means 34 for positioning the fan 5 on and attaching it to the support 2. These means 34 interact with positioning and attachment means 35 provided on the fan. The fan 5 is thus supported by the support. Preferably, the fan 5 is directly supported by the support 2.

The support 2 comprises means and apparatus 36 for positioning the first reflector 6 on and attaching it to the support. These means 36 interact with positioning and attachment means 37 provided on the first reflector 6. Alternatively, the support 2 may only have means for attaching the first reflector 6 to the support 2. Positioning means may be provided on the first reflector 6 in order to interact with positioning means on the radiator 4 or on a first light source, so as to position the first reflector 6 relative to the first light source. The first reflector is thus supported by the support. Preferably, the first reflector 6 is directly supported by the support 2. Again alternatively, the first reflector 6 may be positioned on the radiator 4 and supported by the radiator 4.

The support comprises means 38 for positioning the second reflector 7 on and attaching it to the support. These means interact with positioning and attachment means 39 provided on the second reflector 7. Alternatively, the supports may only have means for attaching the second reflector 7 to the support. Positioning means may be provided on the second reflector 7 in order to interact with positioning means on the radiator 4 or on a second light source, so as to position the second reflector 7 relative to the second light source. The second reflector is thus supported by the support 2. Preferably, the second reflector 7 is directly supported by the support 2. Again alternatively, the second reflector 7 may be positioned on the radiator 4 and supported by the radiator 4.

The support 2 comprises means for positioning the bending element 8 on and attaching it to the support. These means interact with positioning and attachment means provided on the bending element 8. Alternatively, the support 2 may only have means for attaching the bending element 8 to the support 2. Positioning means may be provided on the bending element in order to interact with positioning means on the radiator 4 or on the first light source, so as to position the bending element relative to the first light source. The bending element is thus supported by the support 2. Preferably, the bending element is directly supported by the support 2. Again alternatively, the bending element may be positioned on the radiator and supported by the radiator 4.

The support 2 comprises means 38 for positioning an air-stream guide 13 on and attaching it to the support 2. These means 38 interact with positioning and attachment means 39 provided on the air-stream guide 13. Alternatively, the air-stream guide 13 may be secured to the second reflector 7, as in FIGS. 1 to 5. The air-stream guide 13 is thus supported by the support 2. Preferably, the air-stream guide 13 is directly supported by the support 2.

Preferably, the first light source comprises a first light-emitting diode mounted on a first printed circuit 9 and a second light-emitting diode mounted on a second printed circuit 10. These printed circuits 9 and 10 are preferably positioned on and attached to the radiator 4. The light beams emitted by the first source are reflected by a reflective surface 11 of the first reflector before being partially reflected by the bending element 8 and deflected by the optical lens 3. These various elements form a first optical system making it possible to generate a light beam with cut-off of the low beam type. Preferably, the reflective surface 11 has a first portion in the form of an ellipsoid and a second portion in the form of an ellipsoid. The first diode being at least substantially at the first focal point of the first ellipsoidal portion, the second diode being at least substantially at the first focal point of the second ellipsoidal portion and the bending element being at least substantially at the second focal points of the first and second ellipsoidal portions. The bending element is preferably also at the focal point of the optical lens 3.

Preferably, the second light source comprises a third light-emitting diode mounted on a third printed circuit 19. This printed circuit 19 is preferably positioned on and attached to the radiator 4. The light beams emitted by the second source are reflected by a reflective surface 12 of the second reflector 7 before being diverted by the optical lens 3. These various elements form a second optical system making it possible to generate a complementary portion of the light beam generated by the first optical system so that the first and second beams produce complementarily a light beam of the high beam type. Preferably, the reflective surface 12 is in the form of an ellipsoid. The third diode is at least substantially at the first focal point of the reflective surface 12 and the focal point of the optical lens 3 is at least substantially at the second focal point of the reflective surface 12.

Because of the structure of the optical systems described above, it is understood that it is important for the various components of the optical systems, namely light sources, reflectors, bending element and optical lens, to be positioned precisely relative to one another. In order to do this, there are several solutions. Notably, it is possible to position the lens relative to the support, position the reflectors relative to the support, position the light sources relative to the radiator and position the radiator relative to the support. In this example, the chain of dimensions positioning the light sources relative to the reflectors or relative to the optical lens passes through the radiator and the support. Alternatively, it is possible to position the lens relative to the support, position the reflectors relative to the radiator, position the light sources relative to the radiator and position the radiator relative to the support. In the latter example, the chain of dimensions positioning the light sources relative to the reflectors now passes only through the radiator.

Advantageously, in all the variants, the various components of the optical systems are supported by the support indirectly or preferably directly.

The fan makes it possible to create an airstream 22 flowing between the fins 18 of the radiator and channeled by a guide 13 in order to optimize the heat exchange between the air and the radiator.

Preferably, the various printed circuits supporting the light-emitting diodes are attached to the radiator and positioned relative to the radiator. They are therefore indirectly supported by the support 2, the radiator being attached to the support.

The support furthermore has attachment means allowing it to be attached to a structure of the motor vehicle. Preferably, the attachment means allow it to be attached in a casing of a lighting and/or signaling device, this casing furthermore having means for attachment to the structure of the motor vehicle. The support is preferably produced by molding. It is for example made of metal or plastic, notably of composite.

Figure 4:
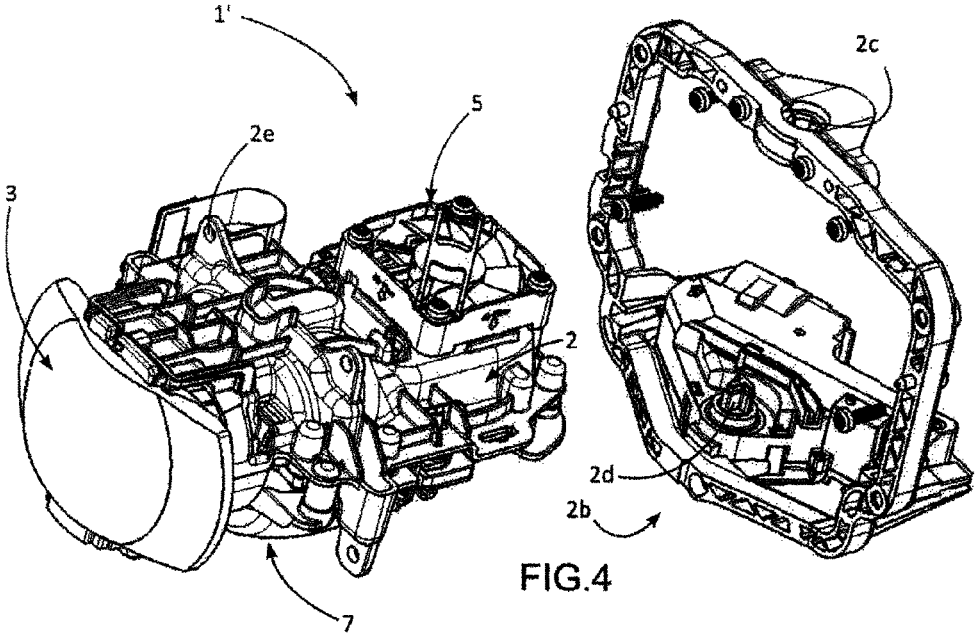
FIG. 4 is an exploded view of a second embodiment of the optical module according to the invention.
Figure 5:
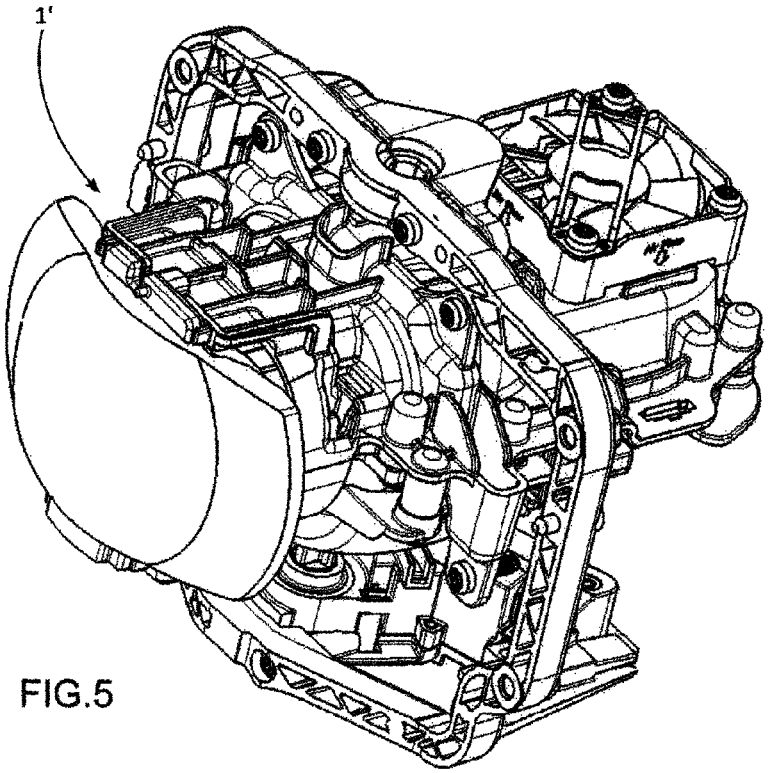
FIG. 5 is a view in perspective of the second embodiment of the optical module according to the invention.

A second embodiment of the optical module according to the invention is described below with reference to FIGS. 4 and 5. It differs from the first embodiment only in the structure of the support 2. Specifically, in this second embodiment, the support 2 comprises first articulation means 2*c* which interact with second articulation means on a base 2*b* designed to be attached in a casing of the lighting and/or signaling device. Thus, the support 2 and hence the optical module can be oriented relative to the casing. The base forms, for example, a frame in which the support is articulated. This articulation is, for example, achieved along a vertical axis, for example by a pivot link. A function of modification of the direction of the optical axis of the light and/or signaling device can thus be achieved when the motor vehicle negotiates a curve. The base may also comprise a maneuvering means such as a gear motor making it possible to control the orientation of the support and hence that of the optical module.

For example, the support may comprise, as first articulation means, a tenon (not shown), for example one tenon at the top of the support and one tenon beneath, the axis passing through these tenons corresponding to the rotation axis of the module relative to the casing. The base may comprise, as second articulation means, orifices designed to interact with the tenons.

According to one variant, the base 2*b* comprises a drive mechanism, from which there emerges a drive shaft 2*d* interacting with an orifice of the module, preferably of the support 2, so as to rotate the support 2. As a variant, and as illustrated, the support 2 may be indirectly connected to the base 2*b* by an intermediate part (not shown for reasons of clarity), for example a frame. The support may then comprise fastening lugs 2*e* attached to the frame. The frame then comprises means interacting with the second articulation means of the base, for example a tenon at the top and an orifice at the bottom, the tenon turning in the top orifice 2*c* of the base and the orifice receiving the drive shaft 2*d*.

Throughout this document, "supporting a component" means the action of absorbing the forces exerted on the component and of transmitting them to the structure of the motor vehicle, the forces being notably those, at a distance, due to forces of acceleration such as weight. Moreover, a part "directly" supporting a component directly absorbs the forces exerted on the component and transmits them to the structure of the motor vehicle, that is to say that there is no intermediate part transmitting the forces between the component and the part. Alternatively, an intermediate part may be provided if its sole function is an interface function. In the latter case, despite the intermediate part, it is considered that the part directly supports the component.

In the various embodiments, the optical module performs a first, low-beam function and a second, high-beam function. However, the optical module according to the invention may perform any other function as a replacement of one and/or the other of the first and second functions. The optical module according to the invention may also perform only one single function of lighting and/or signaling, such as a fog light function.

Throughout this text, the term "at least substantially" used with various "adjectives" means: "adjective" or "substantially adjective", for example "at least substantially perpendicular" means "perpendicular" or "substantially perpendicular".

In the example described, the support 2 is produced in one piece, the support being a monolithic part.

This support 2 is, for example, produced by molding in plastic.

Figure 2:
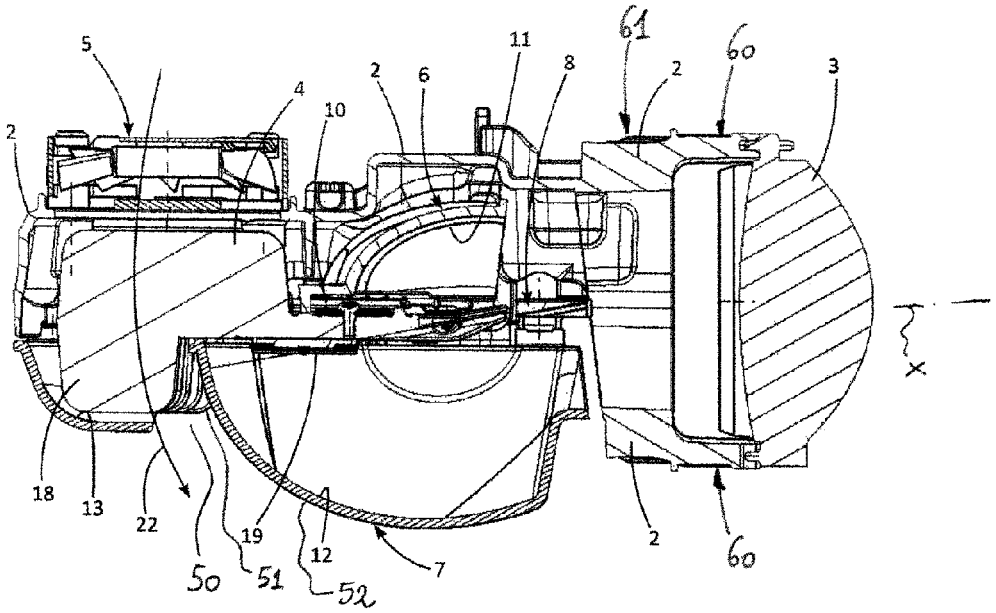
FIG. 2 is a longitudinal section of the first embodiment of the optical module according to the invention.

The second reflector 7 is formed on a part, in particular a monolithic part, namely produced in one piece, provided with a cooling opening 50 for a circulation of cooling air, as illustrated in particular in FIGS. 1 and 2.

The heat exchanger 4 is provided with a plurality of cooling fins 51 which extend facing the cooling opening 50.

The reflector 7 has a domed wall 52 designed to serve to guide the air leaving the cooling opening 50.

Figure 3:
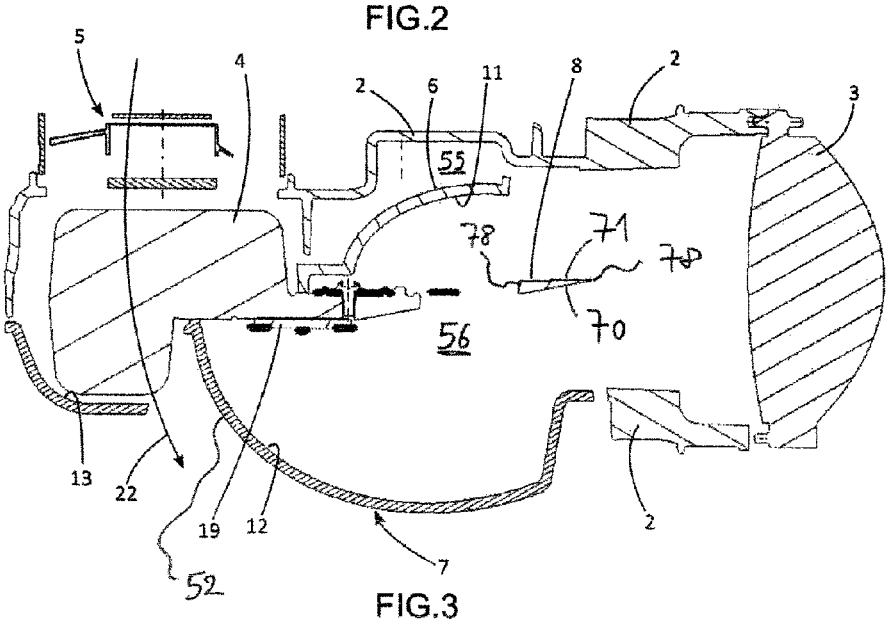
FIG. 3 is a longitudinal section of the first embodiment of the optical module according to the invention.

The support 2 comprises a recess 55 for receiving the reflector 6, as can be seen in FIG. 3, for example.

The reflector 7 forms, together with the support 2, an enclosure 56 receiving the reflector 6, making it possible in particular to have a relatively compact module (see FIG. 3).

The support 2 comprises two fastening arms 60 designed to allow the fastening, in particular by adhesive bonding, of the lens 3, these arms 60 projecting toward the front of the support 2.

These arms are connected to an annular portion 61 of the support 2.

The lens 3 has two opposed rectilinear edges 63 designed to be attached to the arms 60 of the support 2 (see FIG. 1).

The lens comprises, on each edge 63, a fastening lug 65 for fastening the lens 3 to the support 2, this lug 65 being able to interact with one or more pins 66 on the fastening arm 60 of the support (see FIG. 1).

Each of the first and second reflectors 6 and 7 is produced in one piece.

The reflector 6 has two reflective surfaces each associated with a light source.

The bending element 8 is produced on a metal part, preferably a monolithic part.

The bending element 8 is provided with lower 70 and upper 71 reflective surfaces (see FIG. 3 in particular), which are connected so as to form a bevel having an acute angle, this angle being in particular less than 15°, or else less than 5°, or else less than 2° or even less than 1°.

The bending element 8 is formed on a monolithic part, namely produced in one piece, preferably of metal in order to provide in particular a better heat resistance against the heat coming from the light source or sources of the device or from the sun.

The bending element 8 has a cut-off edge 74, with a step 75 (see FIG. 1).

The bending element 8 is formed on a part arranged at a non-zero distance from the heat exchanger 4.

The bending element 8 has front and rear edges 78, which are preferably substantially parallel and in particular substantially rectilinear, the reflective surfaces 70 and 71 of the bending element 8 extending between these edges 78, which are in particular perpendicular to the optical axis x of the module.

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

What is claimed is:

1. An optical module for a lighting and/or signaling device of a motor vehicle, in particular a headlight, comprising:

a light source;

a reflector designed to reflect light coming from said light source;

a bending element placed in a path of light coming from said reflector and designed to reflect light coming from said reflector, said bending element being attached in the optical module in an immovable manner relative to said light source, said bending element being produced on a metal part;

wherein said bending element has a cut-off edge to produce a cut-off in said light;

wherein said bending element is formed on a monolithic part of metal; and wherein said bending element comprises a front edge and a rear edge that are generally parallel and generally rectilinear, a reflective surface or surfaces of said bending element extending between said front edge and said rear edge, which are generally perpendicular to an optical axis of the optical module.

2. The optical module according to claim 1, wherein said bending element is provided with a lower and an upper reflective surface.

3. The optical module according to claim 2, wherein said lower and upper reflective surfaces of said bending element are connected so as to form a bevel having an acute angle.

4. The optical module according to claim 3, wherein said angle is less than 15°.

5. The optical module according to claim 4, wherein said angle is less than 5°.

6. The optical module according to claim 2, wherein said lower and upper surfaces of said bending element are locally planar.

7. The optical module according to claim 2, wherein said lower and upper surfaces are not parallel to one another.

8. The optical module according to claim 1, wherein said bending element comprises at least one machined reflective surface.

9. The optical module according to claim 1, wherein said bending element is formed on a part arranged at a non-zero distance from a heat exchanger.

10. The optical module according claim 3, wherein said angle is less than 2°.

11. The optical module according to claim 4, wherein said angle is less than 1°.

12. The optical module according to claim 3, wherein said lower and upper surfaces of said bending element are locally planar.

13. The optical module according to claim 4, wherein said lower and upper surfaces of said bending element are locally planar.

14. The optical module according to claim 5, wherein said lower and upper surfaces of said bending element are locally planar.

15. The optical module according to claim 3, wherein said lower and upper surfaces are not parallel to one another.

16. The optical module according to claim 4, wherein said lower and upper surfaces are not parallel to one another.

17. The optical module according to claim 5, wherein said lower and upper surfaces are not parallel to one another.

18. The optical module according to claim 8, wherein said bending element is formed on a part arranged at a non-zero distance from a heat exchanger.

19. The optical module according to claim 1, wherein said bending element has a cut-off edge to produce a cut-off in a beam.

20. The optical module according to claim 1, wherein said bending element is formed on a monolithic part of metal.

21. The optical module according to claim 1, wherein said bending element comprises at least one fastening lug designed to allow it to be attached to a support.

22. The optical module according to claim 21, wherein said at least one fastening lug is a lateral lug.

23. The optical module according to claim 21, wherein said bending element comprises two fastening lugs at opposed ends of said bending element.

24. The optical module according to claim 23, wherein said two fastening lugs are arranged at said opposed ends of said bending element in a direction of a largest dimension.

25. The optical module according to claim 24, wherein said direction of said largest dimension of said bending element is generally perpendicular to an optical axis of said optical module.

26. The optical module according to claim 21, wherein said bending element comprises a plurality of fastening lugs.

* * * * *